US007627912B1

(12) United States Patent
McKinney

(10) Patent No.: US 7,627,912 B1
(45) Date of Patent: Dec. 8, 2009

(54) PORTABLE PATIENT TRANSFER SYSTEM

(76) Inventor: Thomas Wade McKinney, #5 Splawn Ct., Canyon, TX (US) 79015

( * ) Notice: Subject to any disclaimer, the term of this patent is extended or adjusted under 35 U.S.C. 154(b) by 0 days.

(21) Appl. No.: 12/381,724

(22) Filed: Mar. 17, 2009

Related U.S. Application Data

(60) Provisional application No. 61/191,325, filed on Sep. 8, 2008.

(51) Int. Cl.
*A61G 7/10* (2006.01)
*A61G 7/14* (2006.01)

(52) U.S. Cl. ..... 5/81.1 R; 5/81.1 T; 5/89.1

(58) Field of Classification Search ..... 5/81.1 R, 5/81.1 T, 89.1, 86.1; 128/874–876; 294/140
See application file for complete search history.

(56) References Cited

U.S. PATENT DOCUMENTS 1,536,766 A * 5/1925 Cammann ..... 212/345
1,876,832 A * 9/1932 Bancroft ..... 5/89.1
1,878,785 A * 9/1932 Leavitt ..... 5/86.1
2,523,891 A * 9/1950 Wallstrom ..... 297/183.6
2,821,406 A * 1/1958 Hoyer et al. ..... 280/657
3,137,011 A * 6/1964 Fischer ..... 5/86.1
3,222,029 A * 12/1965 Hildemann ..... 254/8 R
3,351,959 A * 11/1967 Turpin ..... 5/83.1
3,623,169 A * 11/1971 James ..... 5/87.1
3,629,880 A * 12/1971 van Rhyn ..... 5/83.1
3,694,829 A * 10/1972 Bakker ..... 5/87.1
3,732,584 A * 5/1973 James ..... 5/87.1
3,877,421 A * 4/1975 Brown ..... 601/23
3,967,329 A * 7/1976 Whitton et al. ..... 5/81.1 R
4,054,319 A * 10/1977 Fogg et al. ..... 297/466
4,117,561 A * 10/1978 Zamotin ..... 5/83.1
4,119,164 A * 10/1978 Fogg et al. ..... 180/6.5
4,125,908 A * 11/1978 Vail et al. ..... 5/83.1
4,141,094 A * 2/1979 Ferguson et al. ..... 5/85.1
4,157,593 A * 6/1979 Kristensson ..... 5/87.1
4,221,011 A * 9/1980 Flinchbaugh ..... 5/89.1
4,372,452 A * 2/1983 McCord ..... 212/285
4,390,076 A * 6/1983 Wier et al. ..... 180/11
4,409,696 A * 10/1983 Bakker ..... 5/87.1
4,435,863 A * 3/1984 Lerich ..... 5/87.1
4,456,086 A * 6/1984 Wier et al. ..... 180/11
4,484,366 A * 11/1984 Koontz ..... 5/83.1
4,506,930 A * 3/1985 Lambert ..... 297/423.11
4,510,633 A * 4/1985 Thorne ..... 5/87.1
4,569,094 A * 2/1986 Hart et al. ..... 5/87.1
4,571,758 A * 2/1986 Samuelsson ..... 5/83.1
4,656,679 A * 4/1987 James ..... 5/87.1
4,682,377 A * 7/1987 Reich ..... 5/83.1
4,809,804 A * 3/1989 Houston et al. ..... 180/65.51

(Continued)

FOREIGN PATENT DOCUMENTS

GB 2213734 A * 8/1989

*Primary Examiner*—Robert G Santos
(74) *Attorney, Agent, or Firm*—Norman Rainer

(57) ABSTRACT

A patient lifting system is provided having a vest component adjustably proportioned to fit upon the torso of a patient, and a leg belt component adapted to embrace the patient's legs just below the knees. A caregiver utilizes the lifting system by standing in front of the patient while pulling upon the vest and applying pushing force with his knee upon the leg belt. Such action causes the leg belt to act as a fulcrum which redirects the pulling force upwardly to lift the patient.

5 Claims, 3 Drawing Sheets

U.S. PATENT DOCUMENTS 4,829,612 A * 5/1989 Adams ..... 5/81.1 RP
4,903,355 A * 2/1990 Hickerson ..... 5/83.1
4,918,771 A * 4/1990 James ..... 5/87.1
4,944,056 A * 7/1990 Schroeder et al. ..... 5/85.1
4,944,057 A * 7/1990 Shaw ..... 5/89.1
4,948,156 A * 8/1990 Fortner ..... 280/304.1
5,022,106 A * 6/1991 Richards ..... 5/86.1
5,137,102 A * 8/1992 Houston et al. ..... 180/65.51
5,189,741 A * 3/1993 Beardmore ..... 5/86.1
5,309,584 A * 5/1994 Parker ..... 5/87.1
5,369,821 A * 12/1994 Richards et al. ..... 5/86.1
5,412,820 A * 5/1995 Richards ..... 5/86.1
5,530,976 A * 7/1996 Horcher ..... 5/89.1
5,644,805 A * 7/1997 Horcher ..... 5/86.1
5,647,378 A * 7/1997 Farnum ..... 128/876
5,729,843 A * 3/1998 Manthey ..... 5/89.1
5,878,450 A 3/1999 Bouhuijs
5,884,935 A * 3/1999 Tholkes ..... 280/657
6,073,280 A 6/2000 Farnum
6,122,778 A 9/2000 Cohen
6,134,725 A * 10/2000 Bouhuijs ..... 5/86.1
6,175,973 B1 * 1/2001 Hakamiun et al. ..... 5/89.1
6,276,006 B1 * 8/2001 Hoit ..... 5/81.1 R
6,289,534 B1 9/2001 Hakamiun et al.
6,389,619 B1 * 5/2002 Dunn ..... 5/86.1
6,430,761 B1 * 8/2002 Brandorff et al. ..... 5/86.1
6,440,046 B1 * 8/2002 Tholkes ..... 482/142
6,449,785 B1 * 9/2002 Liljedahl ..... 5/89.1
6,568,002 B1 * 5/2003 Liljedahl ..... 5/86.1
6,578,210 B2 * 6/2003 Erickson ..... 5/89.1
6,581,222 B1 * 6/2003 Liljedahl ..... 5/89.1
6,715,167 B2 4/2004 Wake
6,806,430 B2 * 10/2004 Downing ..... 177/144
6,883,190 B2 4/2005 Carbonneau et al.
7,356,858 B2 4/2008 Summers
7,392,554 B1 * 7/2008 Su et al. ..... 5/86.1
7,540,045 B2 * 6/2009 Nativ ..... 5/86.1
2001/0027574 A1 * 10/2001 Bouhuys ..... 5/86.1
2002/0148042 A1 * 10/2002 Erickson ..... 5/89.1
2003/0140414 A1 * 7/2003 Wake ..... 5/81.1 T
2005/0217025 A1 * 10/2005 Barattia ..... 5/86.1
2005/0268397 A1 * 12/2005 Nativ ..... 5/86.1
2005/0273927 A1 * 12/2005 Tally ..... 5/86.1
2005/0283906 A1 * 12/2005 Summers ..... 5/86.1

* cited by examiner

PORTABLE PATIENT TRANSFER SYSTEM

RELATED APPLICATIONS

This invention is the subject of a Provisional Application filed Sep. 8, 2008 as Ser. No. 61/191,325.

BACKGROUND OF THE INVENTION

1. Field of the Invention

This invention concerns the handling of incapacitated persons, and more particularly relates to a method and apparatus for lifting and moving an injured or invalid person without the aid of heavy duty equipment.

2. Description of the Prior Art

Equipment for lifting patients from a seated position such as a wheelchair to a standing position is well known for use in hospitals. Embodiments of such equipment are described, for example, in U.S. Pat. Nos. 7,356,858 and 5,878,450. Related apparatus for lifting, supporting and transporting a patient is disclosed in U.S. Pat. No. 6,289,534 and elsewhere. The aforesaid equipment, however, is large, cumbersome and expensive, and is intended primarily for use in hospitals and other health care facilities.

It is often necessary to rescue and remove from harm's way individuals involved in accidents, fire, natural disasters or health emergencies. Such persons are usually incapacitated, exhausted or otherwise incapable of assisting in their rescue. Therefore, rescue personnel require means for rapidly securing a victim and facilitating his or her movement to a safer location or a health care facility. The lifting or manipulation of the victim can, however, be a formidable task for the caregiver.

Harness and vest devices such as disclosed in U.S. Pat. No. 6,122,778 and elsewhere have been proposed for the handling of incapacitated persons. Such devices are generally comprised of belts and straps of adjustable length which fit onto the person, and provide hand grips for lifting. Because of their light weight and minimal storage volume, the lifting vests are well suited as equipment for ambulances and other rescue vehicles. However, improvement is still desirable with respect to speed of deployment and minimizing the exertion level and ergonomic stress imposed upon the caregiver.

It is accordingly an object of the present invention to provide an easily storable apparatus which can be quickly applied by a caregiver onto a victim to facilitate lifting.

It is a further object of this invention to provide apparatus of the aforesaid nature which enables a caregiver to more easily lift a victim.

It is an additional object of the present invention to provide a victim lifting method employing the aforesaid apparatus which eases the exertion level and ergonomic stress imposed upon the caregiver.

These objects and other objects and advantages of the invention will be apparent from the following description.

SUMMARY OF THE INVENTION

The above and other beneficial objects and advantages are accomplished in accordance with the present invention by a patient lifting system comprised of:

a) a vest component adjustably proportioned to fit upon the torso of a patient and comprised of:

1) a rear panel of compliant strong material having a front and rear surface and a substantially trapezoidal perimeter defined by two laterally opposed edges upwardly convergent about a center of symmetry, an upper horizontal edge which meets with said laterally opposed edges to form upper corners, and a lower horizontal edge of greater length than said upper edge, and meeting with said laterally opposed edges to form lower corners, 2) shoulder strap means upwardly emergent from each upper corner, downwardly descendant forwardly of said front surface to attachment with the corresponding lower corner, an upper portion of said shoulder strap being of thickened construction to function as a front lifting handle, a lower portion of said strap being padded so as to function as a forearm support, and length adjustment means interactive between said upper and lower portions, and 3) an upper rear lifting strap associated with the upper horizontal edge of said rear panel, and b) a leg belt component extending between releasible interactive buckling extremities adapted to enable said belt to form a closed loop of adjustable size adapted to tightly embrace the patient's legs just below the knees.

In preferred embodiments, paired rear lifting straps may be associated with the laterally opposed edges of the rear panel, and a securing strap may extend horizontally between the lower portions of said shoulder straps in releasible engagement therewith.

In the patient lifting method of this invention, the caregiver places said vest portion on the patient's torso and secures said leg belt about the patient's legs just below the knees. The caregiver then pulls forwardly upon said front lifting handles while at the same time placing his knee between the patient's knees, and in contact with the leg belt. The leg belt thereby functions as a fulcrum which redirects the caregiver's pulling force to impart a lifting effect which pivots about the patient's knees to bring the patient to a standing position. Such manner of lifting enables the caregiver's spine to be erect, thereby transferring lifting force to his hips and legs. In a further embodiment, the patient is instructed to place downward force upon said forearm supports while gripping a forearm. Such action by the patient improves the efficiency of the lifting effect initiated by the caregiver, and minimizes any slippage of the vest.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
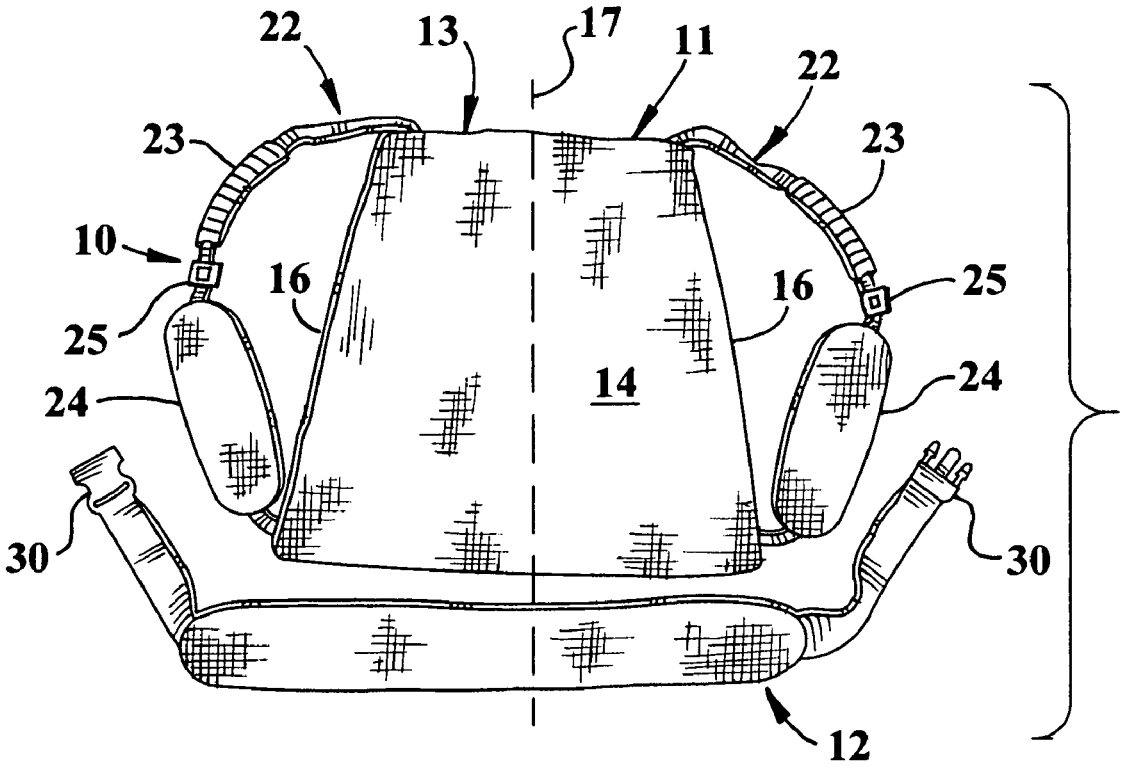
FIG. 1 is a front view of an embodiment of the patient transfer system of the present invention.
Figure 2:
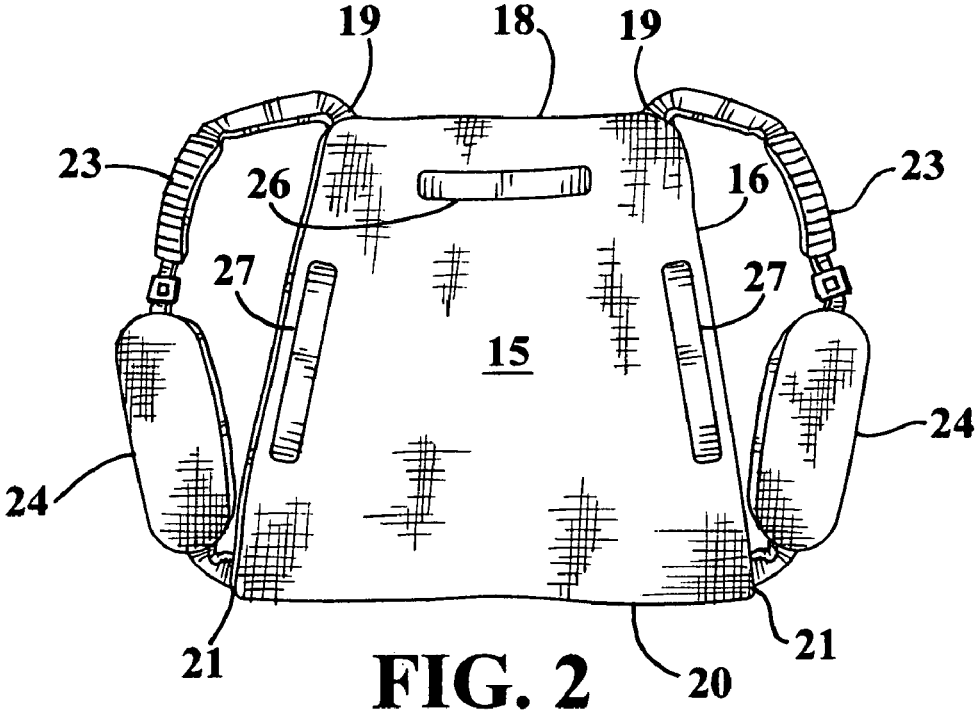
FIG. 2 is a rear view of the vest component of the patient transfer system of FIG. 1.
Figure 3:
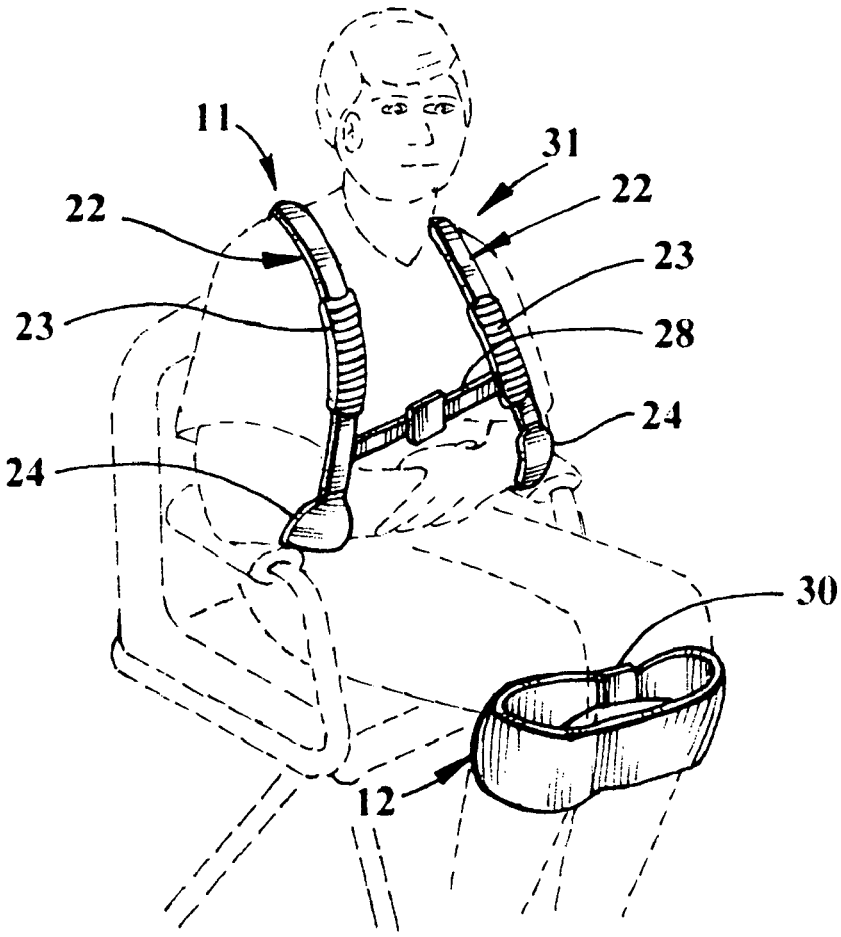
FIG. 3 is a front perspective view of the embodiment of FIG. 1 installed upon a seated patient.
Figure 4:
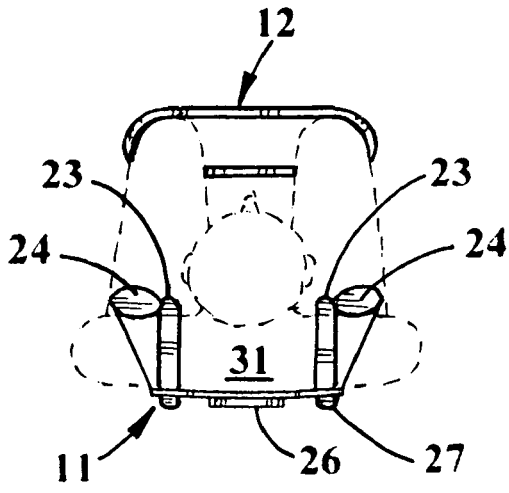
FIG. 4 is a top view of the embodiment of FIG. 3.
Figure 5:
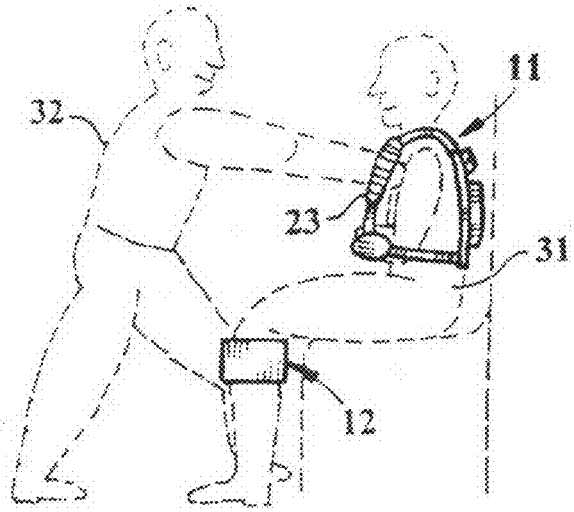
FIG. 5 is a side schematic view which illustrates the lifting method of this invention as applied to a seated patient.
Figure 6:
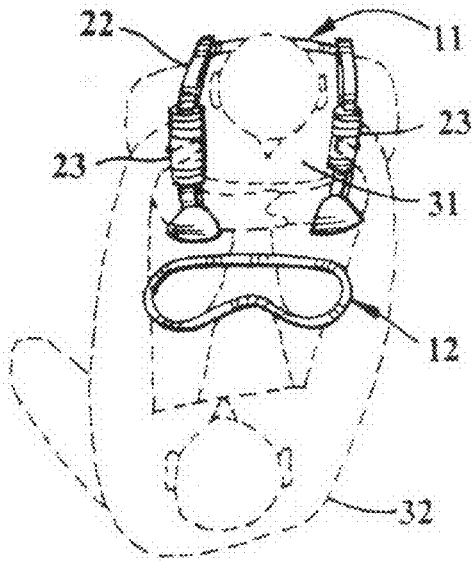
FIG. 6 is a top schematic view of the lifting method of FIG. 5.

Referring now to FIGS. 1-7, an embodiment of the portable patient transfer system 10 of the present invention is shown comprised of vest component 11 and separate leg belt component 12.

Vest component 11 is comprised of a rear panel 13 fabricated of compliant strong material such as a heavy duty fabric tightly woven from high strength synthetic continuous filament yarns such as polypropylene, nylon and polyester. Panel 13 is bounded by front and rear surfaces 14 and 15, respectively, and has a substantially trapezoidal perimeter defined by two laterally opposed edges 16 upwardly convergent about a vertical center of symmetry 17, an upper horizontal edge 18 which meets with said laterally opposed edges to form upper corners 19, and a lower horizontal edge 20 of greater length than said upper edge, and meeting with said laterally opposed edges to form lower corners 21.

Shoulder strap means 22 are upwardly emergent from each upper corner 19, and downwardly descendent forwardly of said front surface to attachment with the corresponding lower corner. An upper portion of each of said shoulder strap means is of thickened construction to function as a front lifting handle 23. A lower portion of said shoulder strap means is flattened, widened and padded so as to function as a forearm support 24. Buckle means 25 which permit rapid engagement, disengagement and length adjustment is interposed between the upper and lower portions of shoulder strap means 22.

An upper rear lifting strap 26 is associated with upper horizontal edge 18 of rear surface 15. Vertically aligned rear lifting handles 27 may optionally be associated with said laterally opposed edges 16. A front transverse belt 28 may optionally extend horizontally between releasible engagement with the lower portions of both shoulder strap means 22.

The leg belt component 12 extends between releasibly interactive attachment extremities 30 adapted to enable the belt to form a closed loop of adjustable size to tightly embrace the patient's legs just below the knees. The several strap components of the patient transfer system of this invention are preferably fabricated of strong nylon webbing, padded where necessary for the patient's comfort.

In the lifting method of this invention, the lifter 32 first places the vest component upon the patient 31, and places the patient's arms in folded position about the elbows with forearms overlapping and resting upon forearm supports 24. The patient is instructed to grip the forearm in lowest position with his upper hand and to press-downwardly hard upon the forearm supports. All appropriate belts are then properly adjusted to produce a tight fit upon the patient's torso.

Figure 7:
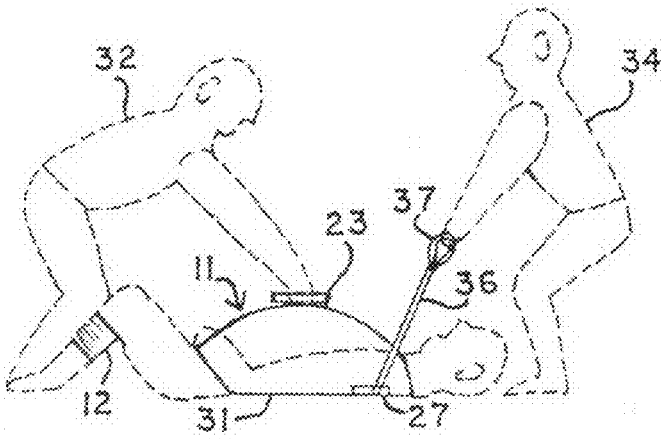
FIG. 7 is a side schematic view which illustrates the lifting method of this invention as applied to a patient in a supine position.

The leg belt component is then applied tautly around the patient's legs just below the knees. The lifter/rescuer, while standing erect in front of a seated patient, grabs front lifting handles 23, and pulls the patient forwardly while applying his knee against the center region of the leg belt component. Such concerted action causes the patient to rise to a standing position while imparting minimal physical stress to the rescuer. In instances where the patient may be very heavy, and particularly when the patient is in a supine position as shown in FIG. 7, another rescuer 34 may help by applying lifting force by way of upper lifting strap 26 and/or rear lifting handles 27. Alternatively, second rescuer 34, positioned behind the patient shown in FIG. 7, may employ paired accessory elongated lifting straps 36 which extend between lower extremities releasibly interactive with lifting handles 27, and upper extremities having gripping loops 37.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A patient lifting system comprised of:

a) a vest component adjustably proportioned to fit upon the torso of a patient and comprised of:

1) a rear panel of compliant strong material having a front and rear surface and a substantially trapezoidal perimeter defined by two laterally opposed edges upwardly convergent about a center of symmetry, an upper horizontal edge which meets with said laterally opposed edges to form upper corners, and a lower horizontal edge of greater length than said upper edge, and meeting with said laterally opposed edges to form lower corners, 2) a shoulder strap upwardly emergent from each upper corner, downwardly descendant forwardly of said front surface to attachment with the corresponding lower corner, an upper portion of said shoulder strap being of thickened construction to function as a front lifting handle, a lower portion of said strap being padded so as to function as a forearm support, and length adjustment means interactive between said upper and lower portions, and 3) an upper rear lifting strap associated with the upper horizontal edge of said rear panel, and b) a leg belt component extending between releasable interactive buckling extremities adapted to enable said belt component to form a closed loop of adjustable size adapted to tightly embrace the patient's legs just below the knees.

2. The lifting system of claim 1 further provided with paired lifting straps associated with the laterally opposed edges of the rear surface of said rear panel.

3. The lifting system of claim 2 further provided with a securing strap extending horizontally between the lower portions of said shoulder straps in releasable engagement therewith.

4. A method for lifting a patient by a caregiver employing the lifting system of claim 1 wherein:

a) the vest component of said lifting system is emplaced on the patient's torso, b) said leg belt component is emplaced upon the patient's legs just below the knees, c) the caregiver pulls forwardly upon said front lifting handles while at the same time placing his knee between the patient's knees and in contact with said leg belt component, thereby causing said leg belt component to function as a fulcrum which redirects the caregiver's pulling force to impart a lifting effect which pivots about the patient's knees to bring the patient to a standing position.

5. The lifting method of claim 4 wherein the patient is instructed to exert downward force upon the forearm supports of said vest component while gripping his forearm.

* * * * *